US012016462B2

(12) United States Patent
Stamper

(10) Patent No.: US 12,016,462 B2
(45) Date of Patent: Jun. 25, 2024

(54) COMBINATION CHAIR/BED FURNITURE AND METHODS OF USE

(71) Applicant: PURDUE RESEARCH FOUNDATION, West Lafayette, IN (US)

(72) Inventor: Piper Delaney Stamper, Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 311 days.

(21) Appl. No.: 17/405,719

(22) Filed: Aug. 18, 2021

(65) Prior Publication Data

US 2022/0053940 A1 Feb. 24, 2022

Related U.S. Application Data

(60) Provisional application No. 63/066,974, filed on Aug. 18, 2020.

(51) Int. Cl.

| | |
|---|---|
| ***A47C 17/13*** | (2006.01) |
| ***A47C 17/04*** | (2006.01) |
| ***A47C 17/34*** | (2006.01) |

(52) U.S. Cl.

CPC ..... *A47C 17/132* (2013.01); *A47C 17/045* (2013.01); *A47C 17/34* (2013.01)

(58) Field of Classification Search

CPC ..... A47C 17/132; A47C 17/045; A47C 17/34; A47C 19/04

See application file for complete search history.

(56) References Cited

U.S. PATENT DOCUMENTS

| | | | | |
|---|---|---|---|---|
| 3,890,658 | A * | 6/1975 | Petersilie | A47C 17/36 5/2.1 |
| 4,236,260 | A * | 12/1980 | Mizelle | A47C 17/132 5/187 |
| 4,326,309 | A * | 4/1982 | Flaum | A47C 17/045 297/440.16 |
| 6,397,411 | B1 * | 6/2002 | Messina | A47C 17/13 5/55.1 |
| 11,246,423 | B2 * | 2/2022 | Kulik | A47C 17/23 |
| 2009/0282611 | A1 * | 11/2009 | Wiberg | A47C 17/132 5/500 |
| 2018/0271294 | A1 * | 9/2018 | Chiriac | A47C 11/005 |

* cited by examiner

*Primary Examiner* — Philip F Gabler

(74) *Attorney, Agent, or Firm* — Hartman Global IP Law; Gary M. Hartman; Domenica N.S. Hartman

(57) ABSTRACT

A combination chair/bed furniture and method of using. The furniture includes a support frame system and a multi-fold cushion assembly adapted to be supported by a frame of the support frame system. The cushion assembly includes folded cushions that define a seat cushion supported by the frame in a chair configuration of the furniture and when extended defines a mattress supported by the frame and at least one mattress support frame of the support frame system in a bed configuration of the furniture. A seat back is supported by the frame in the chair configuration of the furniture and serves as a headboard or additional mattress in the bed configuration.

11 Claims, 6 Drawing Sheets

COMBINATION CHAIR/BED FURNITURE AND METHODS OF USE

CROSS REFERENCE TO RELATED APPLICATIONS

This application claims the benefit of U.S. Provisional Application No. 63/066,974 filed Aug. 18, 2020, the contents of which are incorporated herein by reference.

BACKGROUND OF THE INVENTION

The present invention generally relates to furniture, and in particular to furniture capable of conversion between a chair and a bed.

Due to rapid urbanization, present day apartments are likely to be smaller than typical apartments and condos of the past. Unnecessary furniture is rarely found in studio apartments. The furniture and design industry has made many strides to accommodate these transitions and provide innovative options for individuals who intend to have overnight guests. However, urban dwellers may have trouble finding furniture that is versatile for providing both seating and sleeping of overnight guests. Therefore, it can be appreciated that it would be desirable if furniture was available for both seating and sleeping while having a relatively minimal footprint.

BRIEF DESCRIPTION OF THE INVENTION

The present invention provides furniture and methods of using the furniture as both a chair and a bed.

According to one aspect of the invention, a combination chair/bed furniture is provided that includes a support frame system that includes a frame and at least one mattress support frame, and a multi-fold cushion assembly that is adapted to be received on and supported by the frame. The multi-fold cushion assembly includes first, second, and third cushions that when folded define a seat cushion supported by the frame in a chair configuration of the furniture and when extended define a mattress supported by the frame and the at least one mattress support frame in a bed configuration of the furniture. The first cushion is a lower cushion of the seat cushion and is supported by the frame in the chair configuration of the furniture. The first cushion defines a head portion of the mattress supported by the frame in the bed configuration of the furniture. The second and third cushions are intermediate and upper cushions supported by the first cushion and the frame in the chair configuration of the furniture. The second and third cushions are extendable from the first cushion to define midsection and foot portions of the mattress supported by the at least one mattress support frame in the bed configuration of the furniture. A seat back is received on and supported by the frame in the chair configuration of the furniture and adaptable to serve as a headboard or an additional mattress in the bed configuration.

According to another aspect of the invention, a combination chair/bed furniture is provided that includes a support frame system comprising a frame and at least one mattress support frame, and a multi-fold cushion assembly that is adapted to be received on and supported by the frame. The multi-fold cushion assembly includes first, second, and third cushions that when folded define a seat cushion supported by the frame in a chair configuration of the furniture and when extended define a mattress supported by the frame and the mattress support frame in a bed configuration of the furniture. The first cushion is a lower cushion of the seat cushion and is supported by the frame in the chair configuration of the furniture. The first cushion is supported by the frame and defines a head portion of a mattress in the bed configuration of the furniture. The second and third cushions are intermediate and upper cushions supported by the first cushion and the frame in the chair configuration of the furniture. The second and third cushions are extendable from the first cushion to define midsection and foot portions of the mattress supported by the at least one mattress support frame in the bed configuration of the furniture. A seat back is adapted to be received on and supported by the frame in the chair configuration of the furniture, and is extendable and receivable on the first, second, and third cushions to serve as an additional mattress in the bed configuration of the furniture. The frame and the at least one mattress support frame are each laterally expandable to increase lateral widths thereof in the bed configuration of the furniture so as to accommodate and support the mattress and the additional mattress in a side-by-side arrangement.

According to another aspect of the invention, a method of using a combination chair/bed furniture is provided that includes arranging the furniture in a chair configuration by multi-folding a multi-fold cushion assembly comprising first, second, and third cushions and locating the multi-fold cushion assembly on a frame of the furniture such that the multi-fold cushion assembly defines a seat cushion supported by the frame. The first cushion is a lower cushion of the seat cushion and supported by the frame and the second and third cushions are intermediate and upper cushions supported by the first cushion and the frame. The method further includes locating a seat back on the frame to border the multi-fold cushion assembly on three sides. The method further includes arranging the furniture in a bed configuration by extending the multi-fold cushion assembly to define a mattress supported by the frame and at least one mattress support frame, wherein the first, second, and third cushions define head, midsection, and foot portions of the mattress, the head portion of the mattress is supported by the frame and the midsection and foot portions of the mattress are supported by the at least one mattress support frame.

Technical aspects of the combination chair/bed furniture and method include an all-in-one design that can be quickly converted between a chair and a bed. When configured as a chair, the furniture can store bedding needed for sleeping. Once fully expanded to convert the chair to a bed, stored bedding is revealed for easy access. The frame and mattress support frame are preferably adjustable to varying widths, providing for different sleeping needs, including single and full-size bed sizes to provide sleeping space for one or two individuals.

Other aspects and advantages of this invention will be appreciated from the following detailed description.

DETAILED DESCRIPTION OF THE INVENTION

Figure 1:
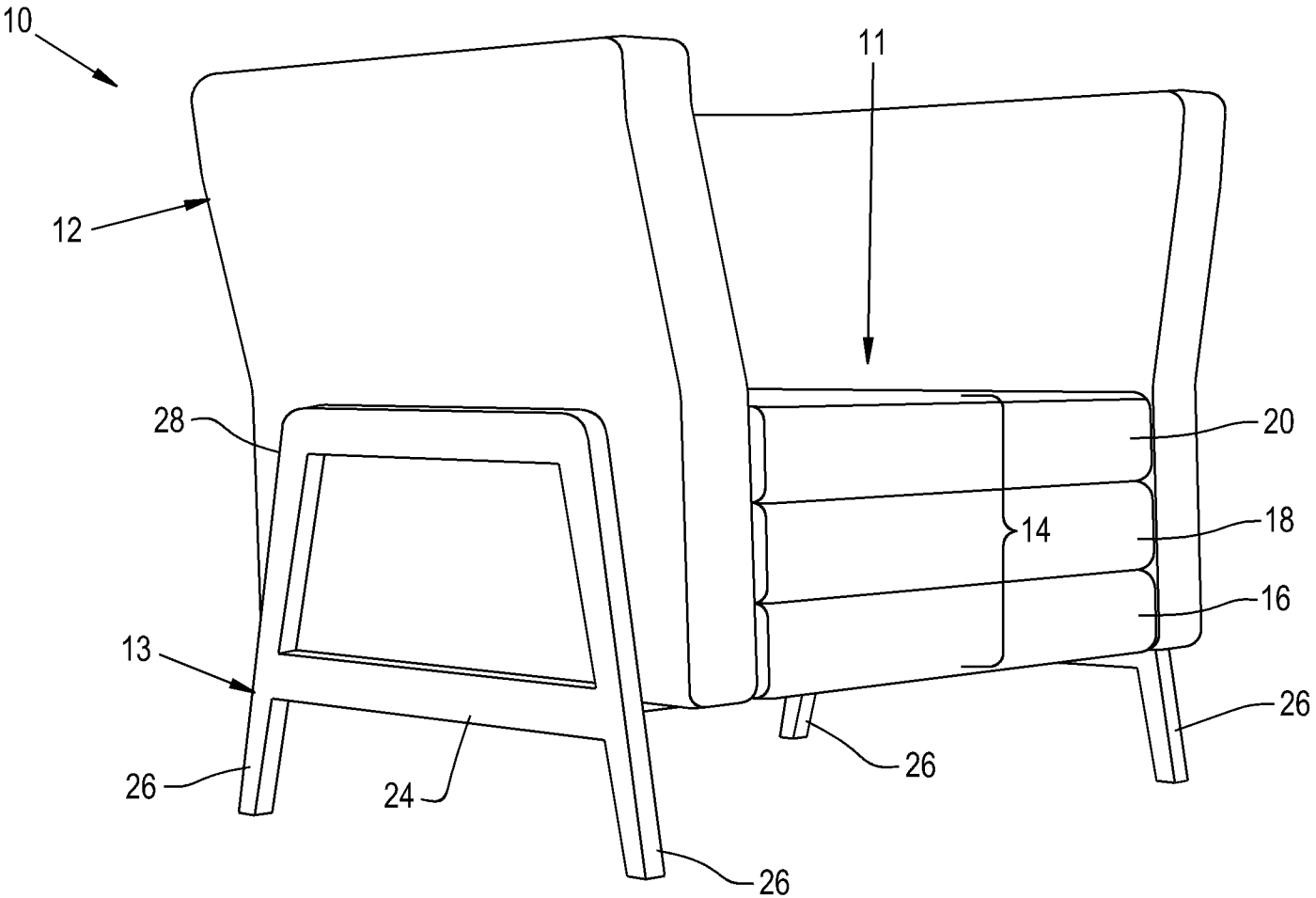
FIGS. 1 and 2 represent perspective views of a combination chair/bed furniture arranged in a chair configuration having a seat cushion, a seat back, and a support frame system in accordance with a nonlimiting embodiment of this invention.

The intended purpose of the following detailed description of the invention and the phraseology and terminology employed therein is to describe what is shown in the drawings, which include the depiction of one or more nonlimiting embodiments of the invention, and to describe certain but not all aspects of what is depicted in the drawings, including the embodiment(s) depicted in the drawings. The following detailed description also identifies certain but not all alternatives of the embodiment(s) depicted in the drawings. Therefore, the appended claims, and not the detailed description, are intended to particularly point out subject matter regarded as the invention, including certain but not necessarily all of the aspects and alternatives described in the detailed description.

FIGS. 1 through 6 represent a nonlimiting embodiment of a combination chair/bed furniture 10 that is convertible between several configurations to meet the needs of various situations, including chair and bed configurations. While arranged in a chair configuration (FIGS. 1 and 2), the furniture 10 may be used for sitting while simultaneously requiring a relatively small footprint. The furniture 10 may be configured to be converted into at least one bed configuration and preferably multiple different bed configurations when additional sitting or sleeping accommodations are desired (FIGS. 3 through 6). As such, the furniture 10 provides a suitable solution for individuals needing versatile furniture for relatively small spaces, such as urban studio apartments and condos.

Figure 2:
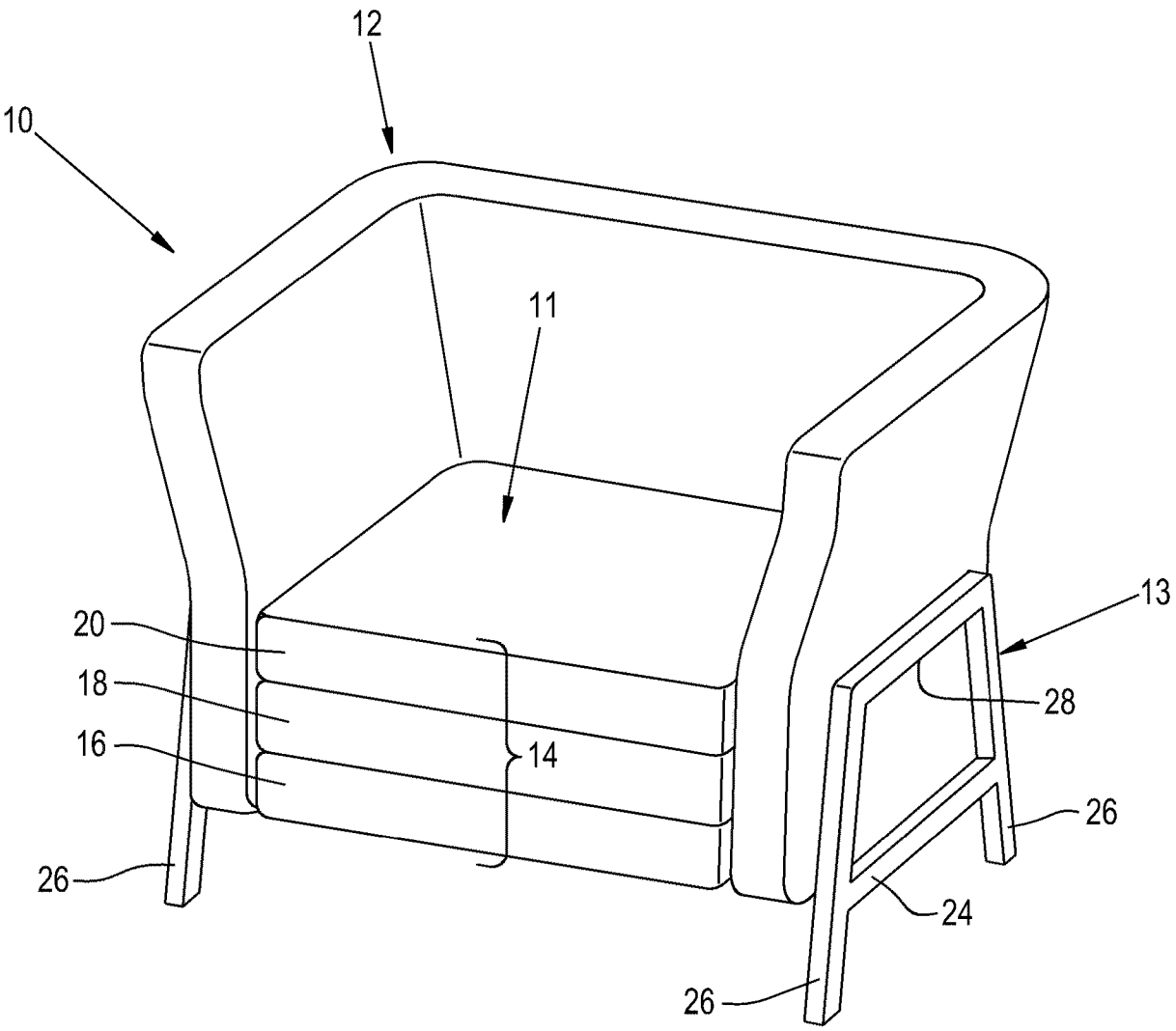

FIGS. 1 and 2 represent the furniture 10 arranged in a chair configuration in which the furniture 10 includes a seat cushion 11 and a seat back 12 supported on a frame 13. The seat cushion 11 is defined by a multi-fold cushion assembly 14 that comprises at least first, second, and third cushions 16, 18, and 20. As such, the cushion assembly 14 will at times also be referred to herein as a tri-fold cushion assembly 14, though it should be understood that the cushion assembly 14 is not limited to having three cushions. In the represented tri-folded arrangement, the first cushion 16 is a lower cushion received directly on and supported by the frame 13, and the second and third cushions 18 and 20 are intermediate and upper cushions, respectively, supported by the first cushion 16 and the frame 13 therebelow. As represented in the nonlimiting embodiment, the cushion assembly 14 is configured to be expanded (unfolded) and utilized as a mattress 22 received on and supported by the frame 13. Additionally, the seat back 12 is configured as a flexible additional cushion of the furniture 10 that may be utilized as a headboard or as an additional mattress that can be directly received on and supported by the mattress 22 or directly received on and supported by the frame 13. Depending on the dimensions of the seat cushion 11 and the seat back 12, the seat back 12 may effectively define armrests as well while the furniture 10 is in the chair configuration.

In the embodiment represented in FIGS. 1 and 2, while in the chair configuration the seat back 12 is oriented on the frame 13 to rest on an edge of the seat back 12 and border the seat cushion 11 on three sides thereof. In the nonlimiting embodiment represented in the drawings, the frame 13 includes a base 24 for supporting the seat cushion 11 and the seat back 12, legs 26 coupled to sides of the base 24 for supporting the furniture 10 in an elevated position relative to a surface on which the frame 13 rests, and oppositely disposed retention members 28 coupled to sides of the base 24 that maintain the seat back 12 in a fixed position while in the chair configuration.

The first cushion 16 of the cushion assembly 14 may be coupled to the frame 13 or a separate component of the furniture 10 that rests on the frame 13. In the represented embodiment, the seat back 12 is not coupled to the frame 13 in the chair configuration. Instead, longitudinal end portions of the seat back 12 are located between the retention members 28 and the lateral sides of the seat cushion 11 which in combination serve to hold and, optionally, pin the seat cushion 11 in position. Alternatively, the seat cushion 11 and/or seat back 12 may be releasably coupled to the frame 13, for example, with straps and/or fasteners (e.g., hook and loop fasteners, snap fasteners, etc.).

Figure 3:
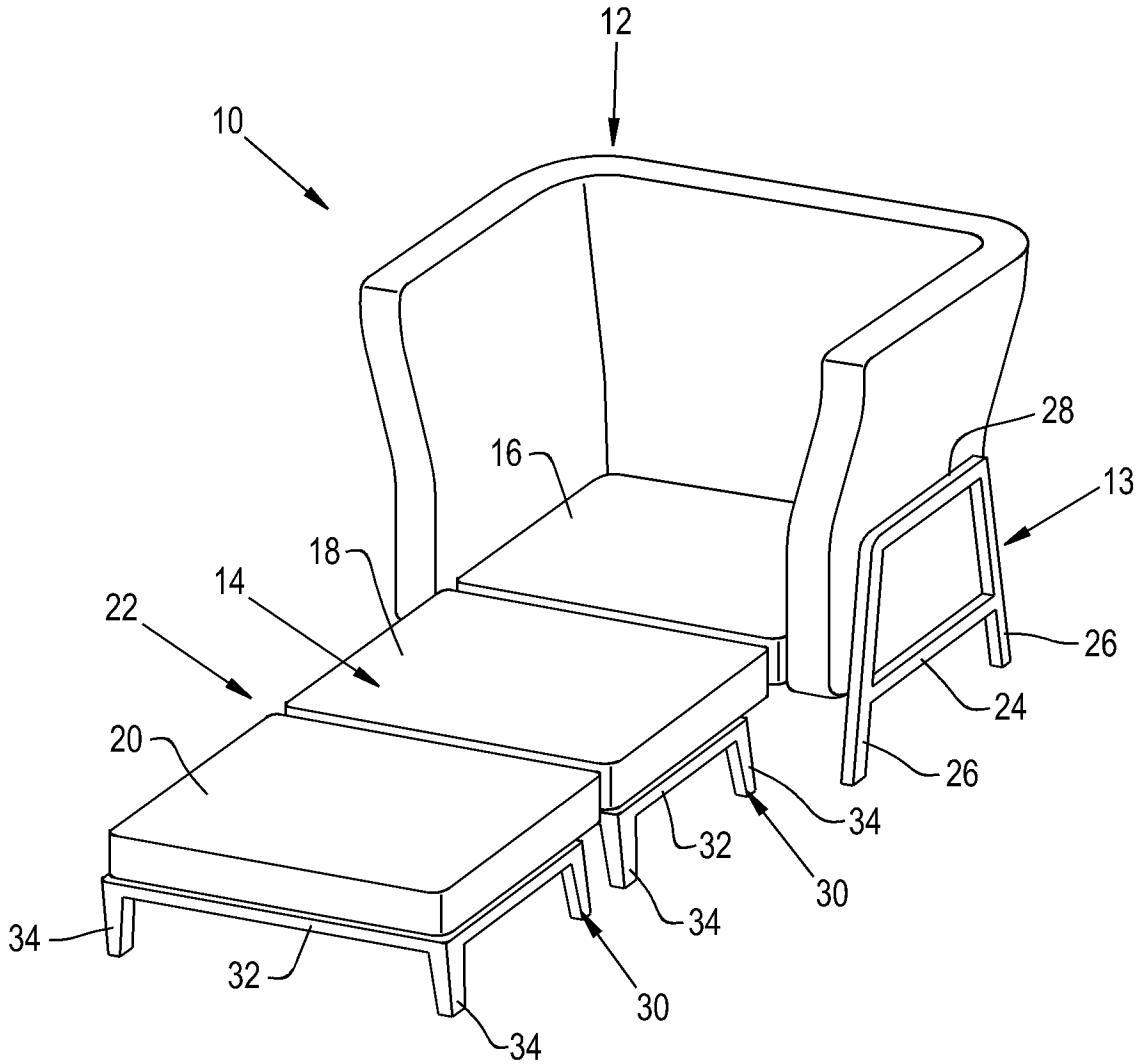
FIG. 3 represents a perspective view of the combination chair/bed furniture of FIGS. 1 and 2 arranged in a bed configuration in which the seat cushion is expanded to serve as a mattress.

FIG. 3 represents the furniture 10 arranged in a first bed configuration in which the mattress 22 formed by unfolding the cushion assembly 14 is supported by one or more mattress support frames 30 and the seat back 12 remains in the same position as shown in FIGS. 1 and 2 to serve as a headboard. The mattress 22 includes a head portion, a midsection, and a foot portion defined by the first, second, and third cushions 16, 18, and 20 of the cushion assembly 14, respectfully. The frame 13 supports the head portion of the mattress 22 and the mattress support frames 30 support the midsection and foot portions of the mattress 22. As such, the frame 13 and mattress support frames 30 in combination can be referred to as separate frame sections of a support frame system that supports the mattress 22. Each mattress support frame 30 is represented as including a base 32 and legs 34. In certain embodiments, the mattress support frames 30 may be stored within or between the second and third cushions 18 and 20 while the cushion assembly 14 is tri-folded. The mattress support frames 30 may be separate components of the furniture 10 or may be coupled to the second and third cushions 18 and 20 of the cushion assembly 14 in which case the legs 34 of the mattress support frames 30 may be deployable from the second and third cushions 18 and 20.

Figure 4:
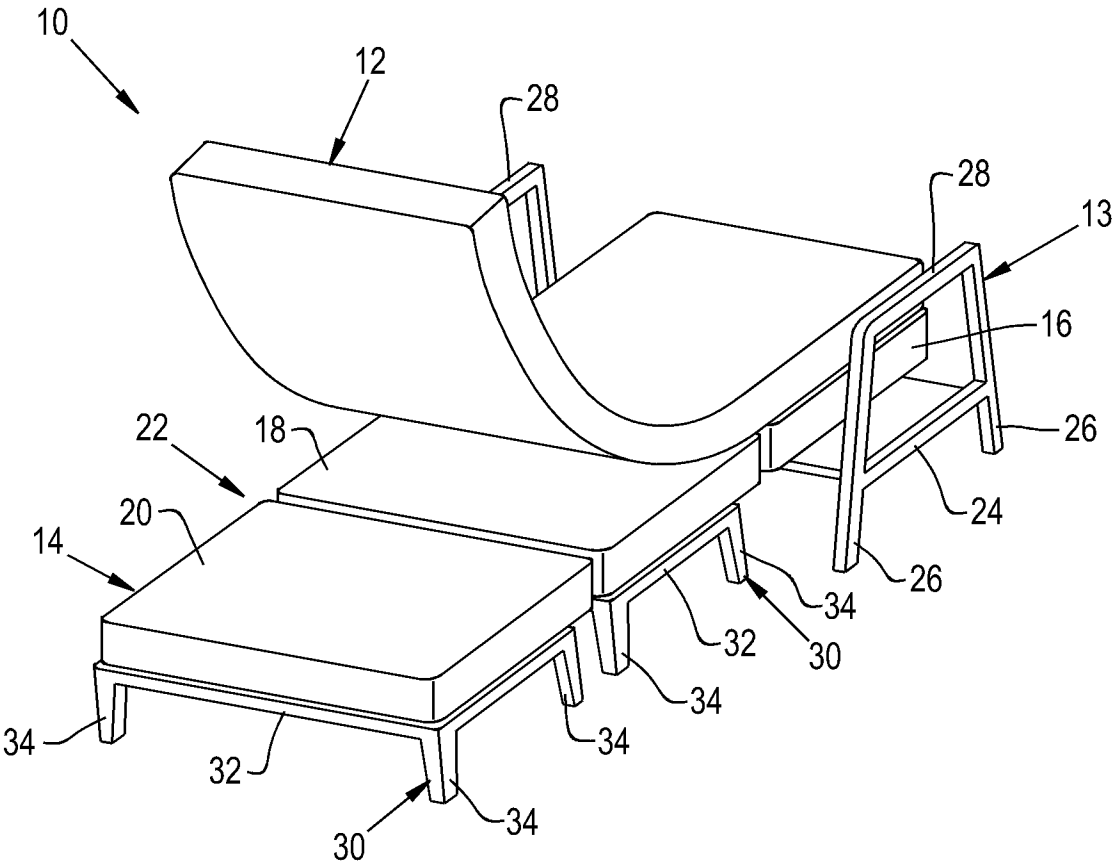
FIG. 4 represents a perspective view of the combination chair/bed furniture of FIGS. 1, 2, and 3 arranged in a bed configuration in which the seat back serves as an additional mattress on top of the mattress.

FIG. 4 represents the furniture 10 in a second bed configuration with the seat back 12 extended and directly received on the mattress 22 formed by the first, second, and third cushions 16, 18, and 20 of the cushion assembly 14 to serve as an additional mattress on top of the mattress 22. A portion of the additional mattress formed by the seat back 12 is lifted in FIG. 4 to expose portions of the underlying mattress 22.

Figure 5:
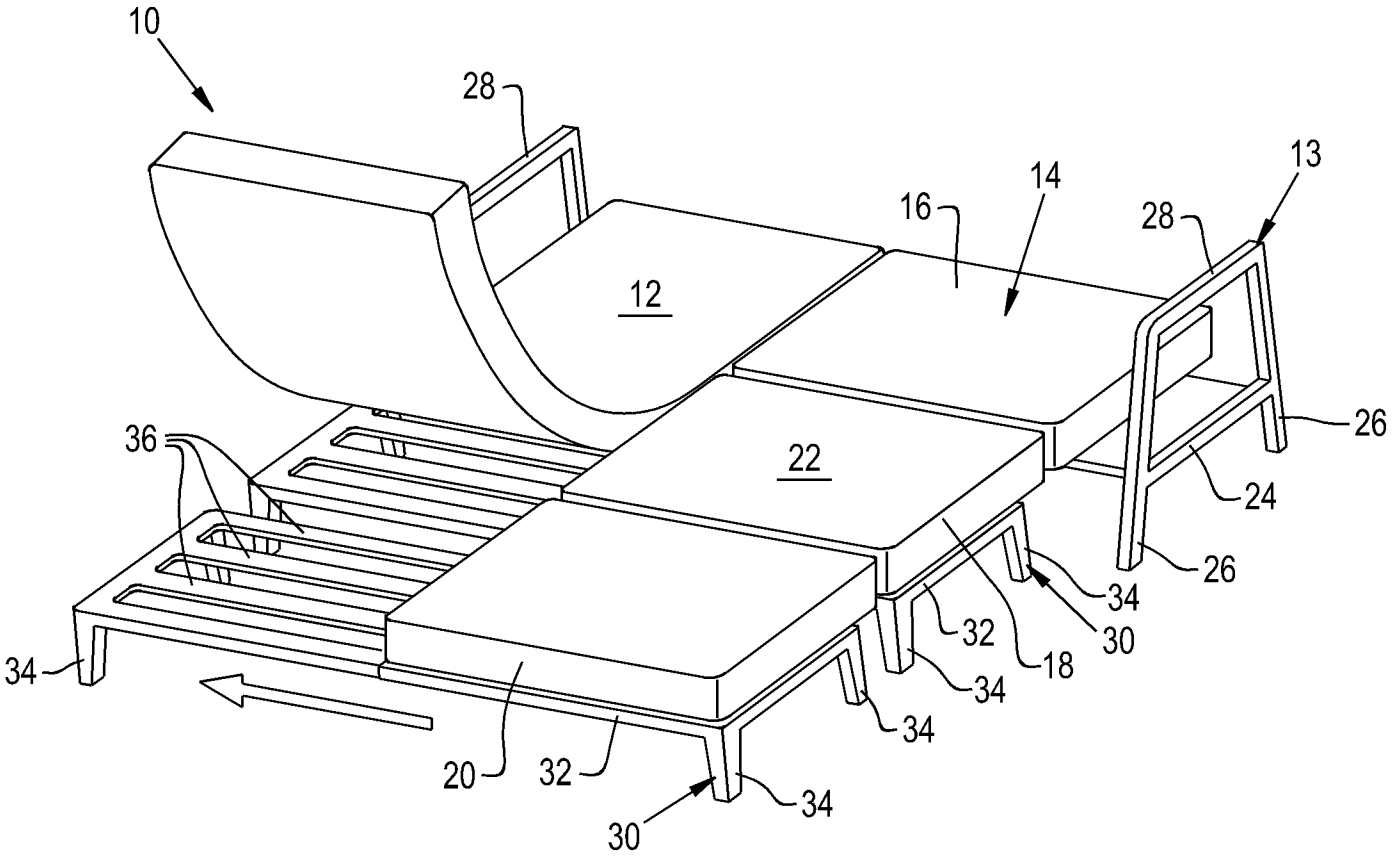
FIG. 5 represents a perspective view of the combination chair/bed furniture of FIGS. 1 through 4 arranged in a bed configuration in which the support frame system is laterally expanded to support the mattress and the additional mattress in a side-by-side configuration.
Figure 6:
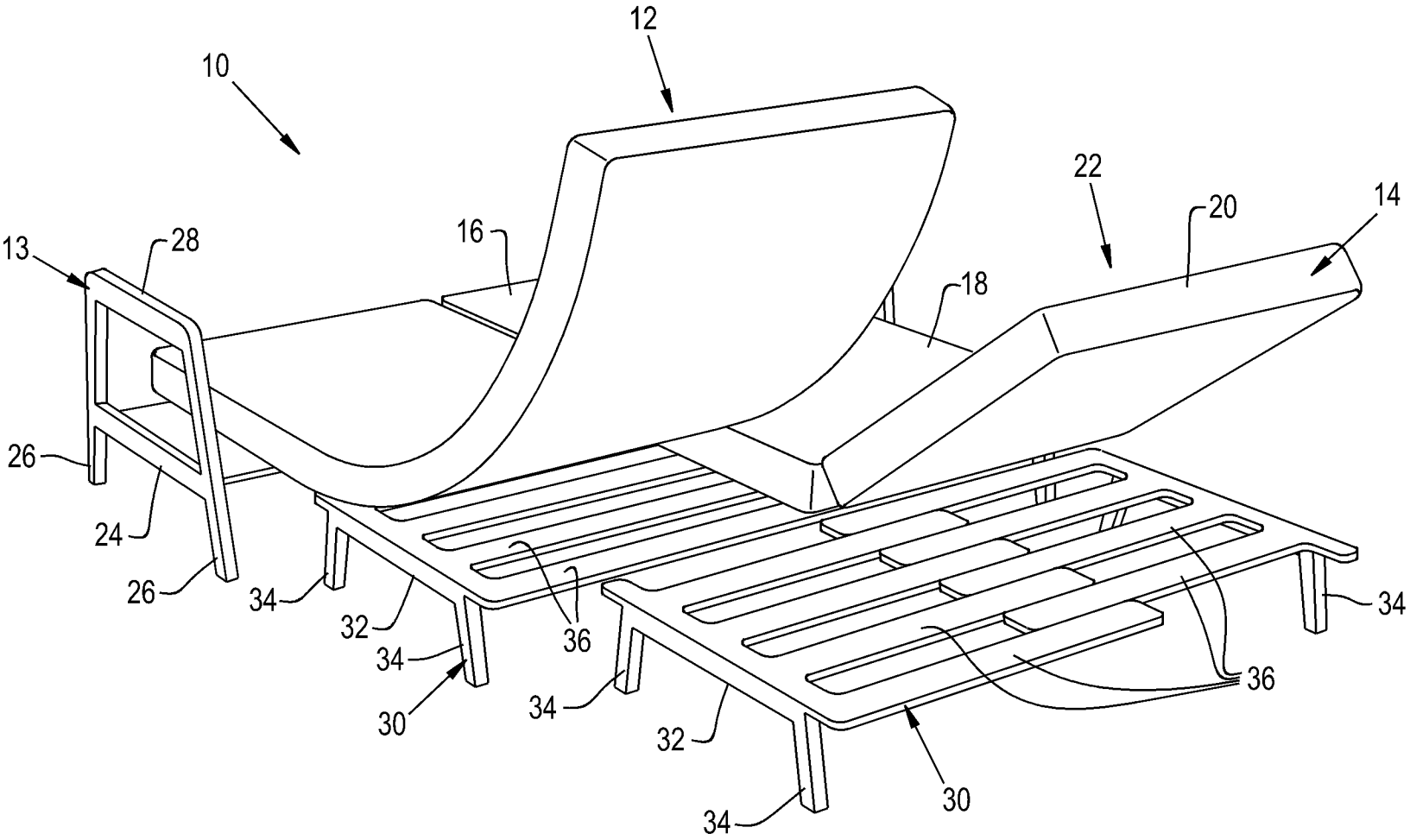
FIG. 6 represents perspective views of the combination chair/bed furniture of FIGS. 1 through 5 that illustrates lateral sliding of interdigitated members of the support frame system.

FIGS. 5 and 6 represent the furniture 10 in a third bed configuration in which the frame 13 and the mattress support frames 30 are each laterally expanded to increase their lateral widths so that the support frame system as a whole is able to accommodate and support the mattress 22 as well as the additional mattress formed by the seat back 12 in a side-by-side arrangement. In the embodiment represented in FIGS. 5 and 6, each frame section of the support frame system, namely, the frame 13 and each mattress support frame 30, comprises a plurality of interdigitated cross members 36 that are configured to slide laterally relative to adjacent ones of the cross members 28 (indicated in FIG. 5 by an arrow). This construction allows for the frame 13 and mattress support frames 30 to be selectively expanded in a lateral direction while remaining sufficiently rigid to support one or more individuals resting thereon. Portions of the mattress 22 and the additional mattress formed by the seat back 12 are lifted in FIGS. 5 and 6 to expose the interdigitated cross members 36 of the mattress support frame 30 that is positioned to serve as the foot of the bed configuration.

In view of the foregoing, the furniture 10 represented in the drawings may be arranged in a chair configuration by tri-folding the first, second, and third cushions 16, 18, and 20 of the cushion assembly 14 and locating the cushion assembly 14 on the frame 13 such that the cushion assembly 14 defines the seat cushion 11 supported by the frame 13. The seat back 12 may be located on the frame 13 such that the seat back 12 serves as a conventional back rest used in combination with the seat cushion 13. In the embodiment represented in FIGS. 1 and 2, the seat back 12 is located between the cushion assembly 14 and the retention members 28 of the frame 13.

The furniture 10 may be converted from the chair configuration to any one of the bed configurations of FIGS. 3 through 6 by unfolding and extending the first, second, and third cushions 16, 18, and 20 of the cushion assembly 14 to define the mattress 22 supported by the frame 13 and one or more mattress support frames 30. As discussed above, in certain bed configurations the seat back 12 may remain in position to define a headboard as shown in FIG. 3 or extended and used as an additional mattress as shown in FIGS. 4 through 6. In certain embodiments, the mattress support frames 30 may be coupled to the second and third cushions 18 and 20 and configured to automatically deploy when the second and third cushions 18 and 20 are extended from the first cushion 16, for example, due to gravity, biasing members, or mechanical linkages. Alternatively, the legs 34 may be manually deployable. In other embodiments, the mattress support frames 30 may be separate components that are collapsible and stored beneath the frame 13, or between the second and third cushions 18 and 20, or within recesses or compartments of the second and third cushions 18 and 20. In such embodiments, the mattress support frames 30 may be removed, deployed, and located below the extended second and third cushions 18 and 20. In yet other embodiments, the mattress support frames 30 may be separate components that are stored elsewhere and not associated with the furniture 10 when the furniture 10 is arranged in the chair configuration. In such embodiments, the mattress support frames 30 may be retrieved, deployed (if necessary), and located below the extended second and third cushions 18 and 20.

In embodiments in which the frame 13 and/or mattress support frames 30 are not coupled to the cushion assembly 14, the first, second, and/or third cushions may be releasably coupled to the frame 13 and/or mattress support frames 30, for example, with straps and/or fasteners (e.g., hook and loop fasteners, snap fasteners, etc.). In embodiments in which the frame 13 and/or mattress support frames 30 are not coupled to the cushion assembly 14 or each other, the frame 13 and/or mattress support frames 30 may include locking mechanisms (not shown) configured for releasably securing the frame 13 and/or mattress support frames 30 to each other to promote rigidity of the mattress support frame 30 in the bed configuration.

The components of the furniture 10 may have various dimensions. In certain embodiments, the mattress 22 preferably includes a width and length that are sufficient to comfortably accommodate at least one person while lying on the mattress 22 in a supine position, and the mattress 22 and the additional mattress formed by the seat back 12 may in combination have a side-by-side width and length sufficient to comfortably accommodate at least two people while lying in side-by-side supine positions. Such dimensions may be based on size standards for beds. For example, the mattress 22 and seat back 12 may have widths and lengths corresponding to a standard single or twin-size bed, and in combination may have side-by-side widths and lengths corresponding to a standard full or double-size bed. Although such standard dimensions may vary between manufacturers and regions, nonlimiting examples may include the mattress 22 and/or seat back 12 having widths of at least about 70 cm and lengths of at least 180 cm. In certain embodiments, the mattress 22 and the seat back 12 may have identical dimensions whereas in other embodiments the mattress 22 and seat back 12 may have one or more different dimensions.

The furniture 10 and its components may be fabricated from various materials including, for example, materials used in the construction of existing furniture including chairs and beds. As examples, the seat back 12 and the cushions 16, 18, and 20 of the cushion assembly 14 may each include a cover formed of a woven or nonwoven fabric material having a cushioning material encased therein formed of a polymeric foam material. Optionally, the seat back 12 and cushions 16, 18, and 20 may include spring coils similar to those conventionally used in spring mattress cores (i.e., innersprings). The frame 13 and mattress support frames 30 may be formed of various rigid materials such as wood materials, metallic materials, polymeric materials, composite materials, and/or combinations thereof.

While the invention has been described in terms of specific embodiments, it is apparent that other forms could be adopted by one skilled in the art. For example, the physical configuration of the furniture 10 could differ from that shown, and materials and processes/methods other than those noted could be used. Therefore, the scope of the invention is to be limited only by the following claims.

The invention claimed is:

1. A combination chair/bed furniture comprising:

a support frame system comprising a frame and at least one mattress support frame;

a multi-fold cushion assembly adapted to be received on and supported by the frame, the multi-fold cushion assembly comprising first, second, and third cushions that when folded define a seat cushion supported by the frame in a chair configuration of the furniture and when extended define a mattress supported by the frame and the at least one mattress support frame in a bed configuration of the furniture, the first cushion being a lower cushion of the seat cushion and supported by the frame in the chair configuration of the furniture, the first cushion defining a head portion of the mattress supported by the frame in the bed configuration of the furniture, the second and third cushions being intermediate and upper cushions supported by the first cushion and the frame in the chair configuration of the furniture, the second and third cushions being extendable from the first cushion to define midsection and foot portions of the mattress supported by the at least one mattress support frame in the bed configuration of the furniture; and a seat back comprising a flexible cushion received on and supported by the frame in the chair configuration of the furniture and adaptable to serve as either one of a headboard and an additional mattress in the bed configuration;

wherein the flexible cushion of the seat back surrounds and borders an outer periphery of the multi-fold cushion on three sides thereof in the chair configuration of the furniture.

2. The combination chair/bed furniture of claim 1, wherein the at least one mattress support frame comprises first and second mattress support frames stored within the second and third cushions, respectively, while the first, second, and third cushions are folded to define the seat cushion.

3. The combination chair/bed furniture of claim 1, wherein a side of the seat back rests directly on the frame in the chair configuration of the furniture.

4. The combination chair/bed furniture of claim 1, wherein the seat back is supported by oppositely-disposed retention members of the frame in the chair configuration of the furniture.

5. The combination chair/bed furniture of claim 1, wherein the seat back when adapted to serve as the additional mattress is extendable and receivable on the first, second, and third cushions to serve as the additional mattress in the bed configuration of the furniture.

6. The combination chair/bed furniture of claim 1, wherein the frame and the at least one mattress support frame are each laterally expandable to increase lateral widths thereof in the bed configuration of the furniture so as to accommodate and support the mattress and the seat back when adapted to serve as the additional mattress in a side-by-side arrangement.

7. The combination chair/bed furniture of claim 6, wherein the frame and the at least one mattress support frame each include a plurality of interdigitated cross members each configured to slide laterally relative to adjacent ones of the cross members.

8. The combination chair/bed furniture of claim 1, wherein the at least one mattress support frame is coupled to one of the second and third cushions.

9. The combination chair/bed furniture of claim 1, wherein the at least one mattress support frame is not coupled to the second cushion or third cushion.

10. A combination chair/bed furniture comprising:

a support frame system comprising a frame and at least one mattress support frame;

a multi-fold cushion assembly adapted to be received on and supported by the frame, the multi-fold cushion assembly comprising first, second, and third cushions that when folded define a seat cushion supported by the frame in a chair configuration of the furniture and when extended define a mattress supported by the frame and the at least one mattress support frame in a bed configuration of the furniture, the first cushion being a lower cushion of the seat cushion and supported by the frame in the chair configuration of the furniture, the first cushion being supported by the frame and defining a head portion of the mattress in the bed configuration of the furniture, the second and third cushions being intermediate and upper cushions supported by the first cushion and the frame in the chair configuration of the furniture, the second and third cushions being extendable from the first cushion to define midsection and foot portions of the mattress supported by the at least one mattress support frame in the bed configuration of the furniture; and a seat back comprising a flexible cushion received on and supported by the frame in the chair configuration of the furniture with the flexible cushion of the seat back surrounding and bordering an outer periphery of the multi-fold cushion on three sides thereof and longitudinal ends of the seat back located between oppositely-disposed retention members of the frame and lateral sides of the multi-fold cushion, the seat back being extendable and receivable on the first, second, and third cushions to serve as an additional mattress in the bed configuration of the furniture;

wherein the frame and the at least one mattress support frame are each laterally expandable to increase lateral widths thereof in the bed configuration of the furniture so as to accommodate and support the mattress and the additional mattress in a side-by-side arrangement.

11. The combination chair/bed furniture of claim 10, wherein the frame and the at least one mattress support frame each include a plurality of interdigitated cross members each configured to slide laterally relative to adjacent ones of the cross members.

* * * * *